United States Patent [19]

Mrotz, III

[11] Patent Number: 5,015,038

[45] Date of Patent: May 14, 1991

[54] ERGONOMIC SEAT AND BACK STRUCTURE FOR A CHAIR

[75] Inventor: Walter C. Mrotz, III, North Muskegon, Mich.

[73] Assignee: The Shaw-Walker Company, Muskegon, Mich.

[21] Appl. No.: 581,069

[22] Filed: Sep. 10, 1990

Related U.S. Application Data

[63] Continuation of Ser. No. 364,965, Jun. 12, 1989, abandoned.

[51] Int. Cl.[5] ..... A47C 7/02

[52] U.S. Cl. ..... 297/457; 297/DIG. 2; 297/444

[58] Field of Search ..... 297/457, 454, 452, 445, 297/DIG. 2, 444

[56] References Cited

U.S. PATENT DOCUMENTS

| | | | |
|---|---|---|---|
| 2,993,733 | 7/1961 | Pinkham | 297/454 X |
| 3,669,499 | 6/1972 | Semplonius | 297/445 X |
| 4,018,479 | 4/1977 | Ball | 397/457 X |
| 4,045,080 | 8/1977 | Barecki | 297/454 X |
| 4,529,247 | 7/1985 | Stumpf | 297/457 X |
| 4,577,907 | 3/1986 | Talmon et al. | 297/DIG. 2 |
| 4,647,109 | 3/1987 | Christophersen et al. | 297/457 |

*Primary Examiner*—José V. Chen

*Attorney, Agent, or Firm*—Kinzer, Plyer, Dorn, McEachran & Jambor

[57] ABSTRACT

A seat and back construction for an ergonomic office chair. An ergonomically functioning inner shell is mounted on a chair structure in a manner that does not interfere with the flexible characteristics of the inner shell. An outer rigid shell is provided to transfer static and dynamic loads applied to the back portion of the inner shell by an occupant directly to the chair structure without interfering with the flexible characteristics of the inner shell.

8 Claims, 4 Drawing Sheets

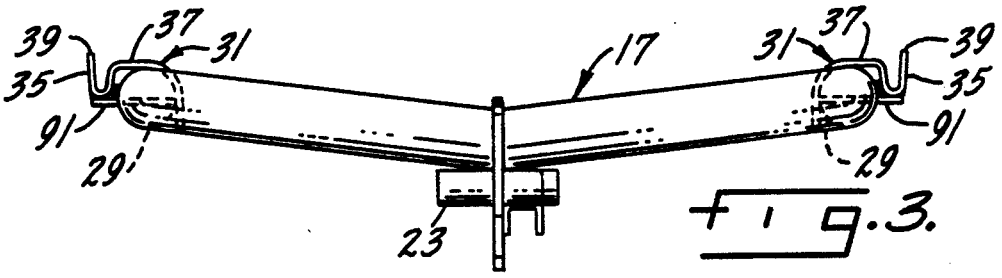
Fig. 3.
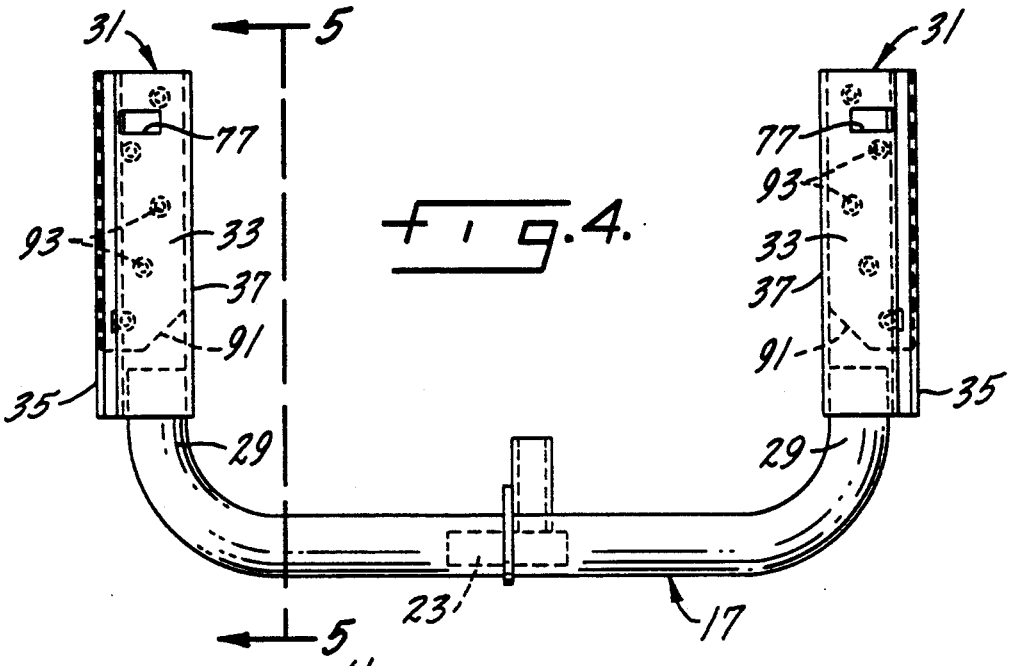
Fig. 4.
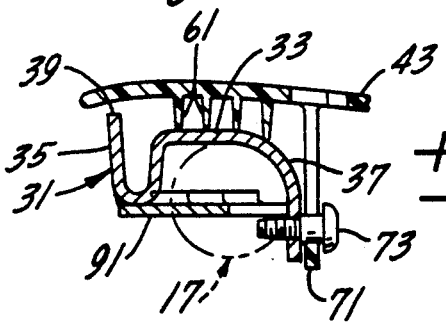
Fig. 6.
Fig. 5.
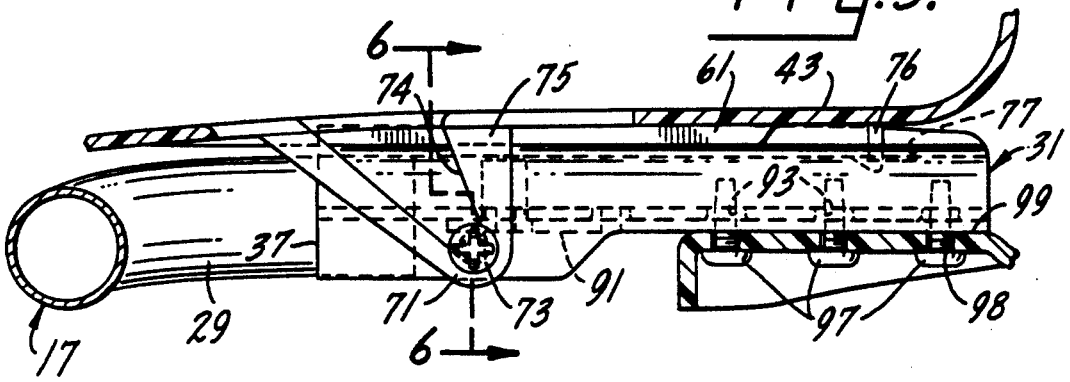

105
59
45
105
76
76
43
47
53
47
71
71
49
55
57
51
51
41
46

117
117
117
59
117
105
105
103
103
45
41
51
57
51
43
71
46
71

ERGONOMIC SEAT AND BACK STRUCTURE FOR A CHAIR

This is a continuation of copending application Ser. No. 07/364,965 filed on June 12, 1989 now abandoned.

BACKGROUND AND SUMMARY OF THE INVENTION

This invention is directed generally to a seat and back construction for a passive ergonomic chair, primarily a chair of the office type.

This invention is more specifically directed to a passive ergonomic office chair of the knee-tilt type in which the horizontal pivoting axis of the seat and back is located near the front of the chair. However, the invention is not limited to chairs of these specific types since aspects of the invention may have application to other types of office chairs and other chairs of all kinds.

The invention is particularly adaptable to passive ergonomic chairs of the type shown and described in U.S. Pat. No. 4,660,887, issued to the assignee of this invention. Some embodiments of ergonomic chairs described in said patent have a resilient and flexible inner shell formed of plastic in which openings in the inner shell provide flexible, cantilevered support members in the seat and back portions of the inner shell. These flexible, cantilevered support members enable the plastic inner shell to more closely and comfortably conform to the body of a user.

An object of this invention is to mount a resilient and flexible inner shell on the structure of a knee-tilt chair so as to enhance the ergonomic features of the inner shell.

Another object of this invention is to mount a resilient and flexible inner shell having flexible, cantilevered support members on a chair pedestal post in such a manner that the mounting structure does not interfere with the flexing of the flexible, cantilevered support members.

Another object of this invention is a knee-tilt chair having a resilient and flexible inner shell in which the load applied by an occupant to the back portion of the inner shell is transferred to the seat-supporting structure through an outer shell that is much more rigid than the inner shell.

Another object of this invention is a chair seat and back structure having inner and outer shells in which the outer shell supports and strengthens the back portion of the inner shell.

Other objects of this invention may be found in the following specification, claims and drawings.

BRIEF DESCRIPTION OF THE DRAWINGS

FIG. 3 is a front elevational view of the stretcher tube and brackets which support the seat and back structure of the chair of this invention;

FIG. 4 is a top plan view of the stretcher tube and brackets of FIG. 3;

FIG. 5 is an enlarged view taken along line 5—5 of FIG. 4 and showing portions of the inner shell and outer shell fastened to the brackets;

FIG. 6 is a cross-sectional view taken along line 6—6 of FIG. 5;

DESCRIPTION OF THE PREFERRED EMBODIMENT

Figure 1:
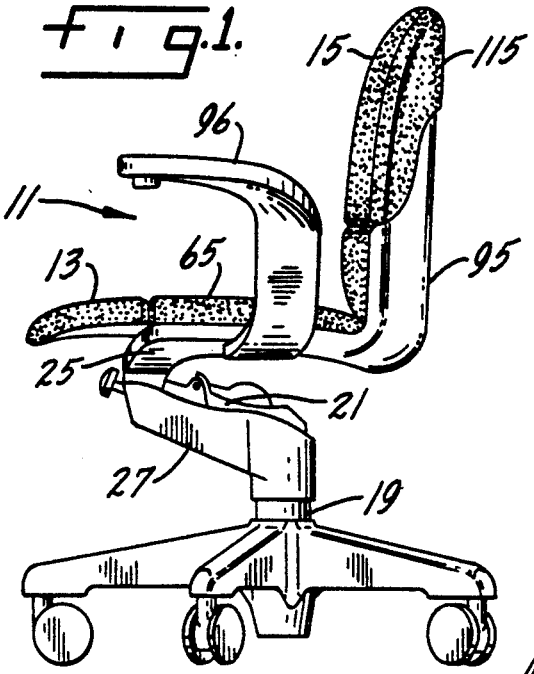
FIG. 1 of the drawings is a side elevational view of a knee-tilt type office chair embodying the novel features of this invention.
Figure 2:
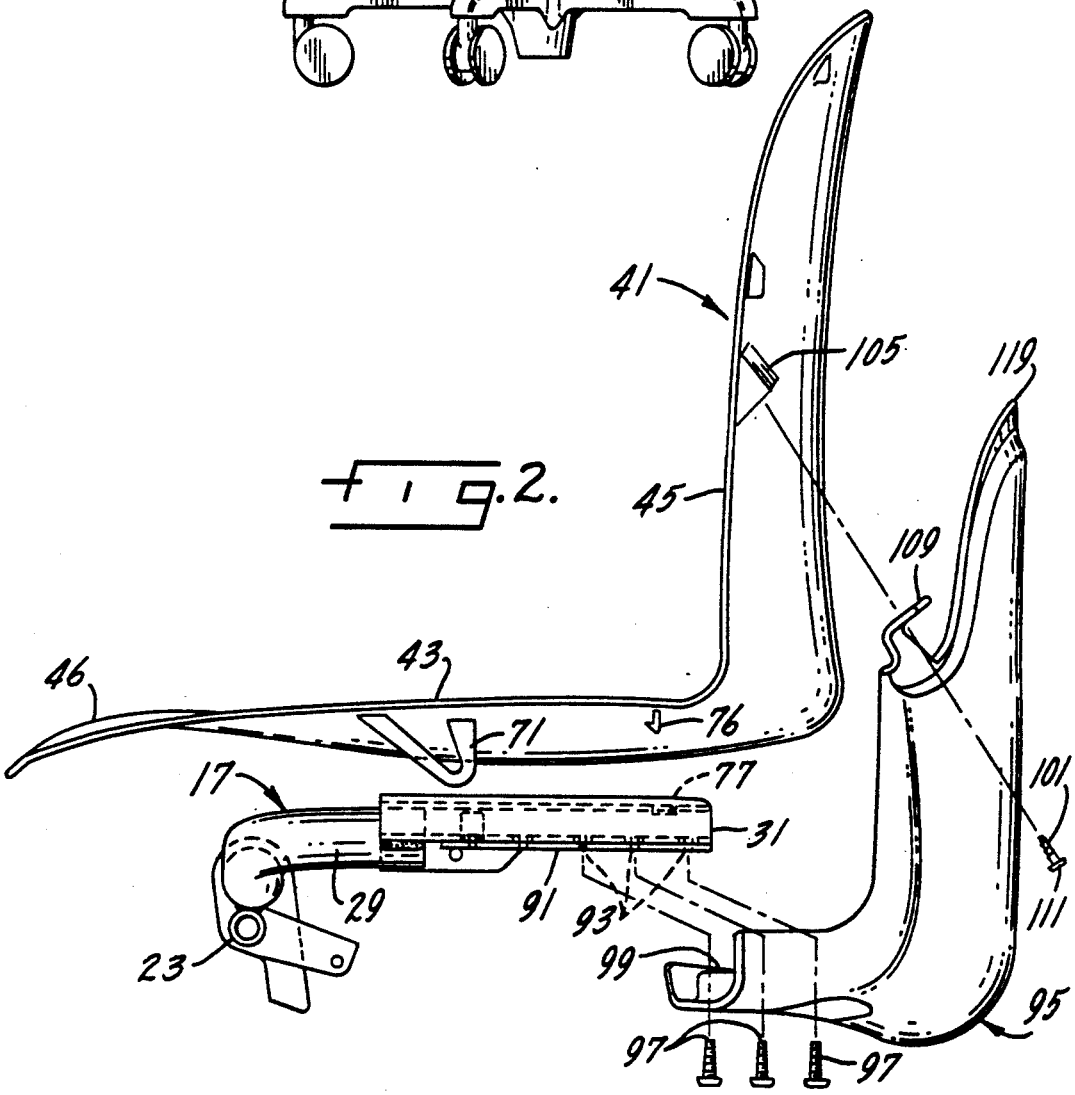
FIG. 2 is an enlarged, exploded, side elevational view of the seat and back portions of the chair of this invention, with parts omitted for clarity of illustration.
Figure 7:
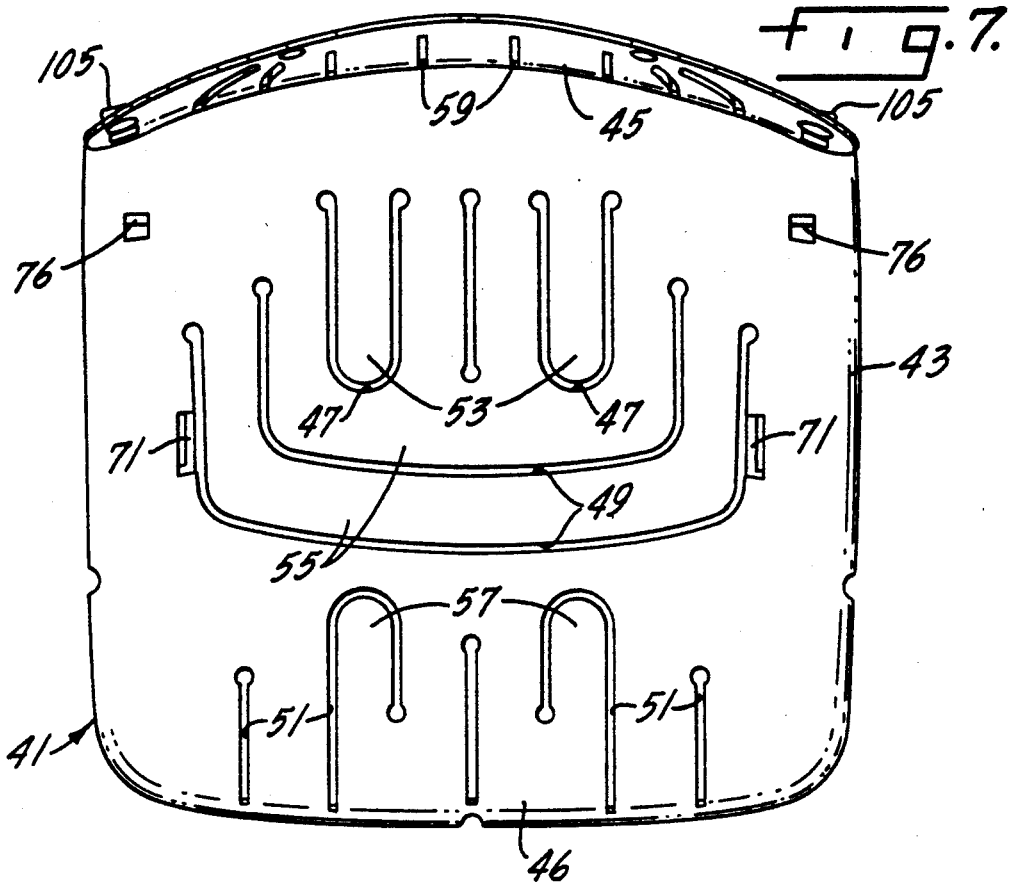
FIG. 7 is a top plan view of the inner shell.
Figure 8:
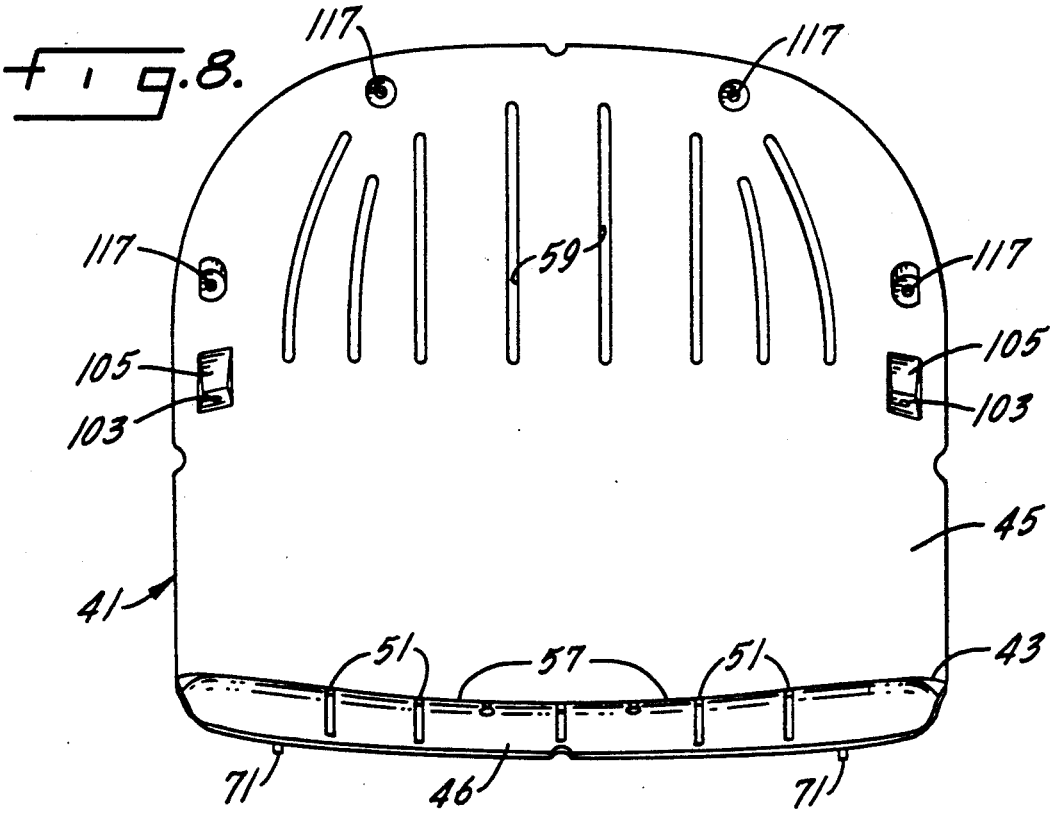
FIG. 8 is a front elevational view of the inner shell.
Figure 9:
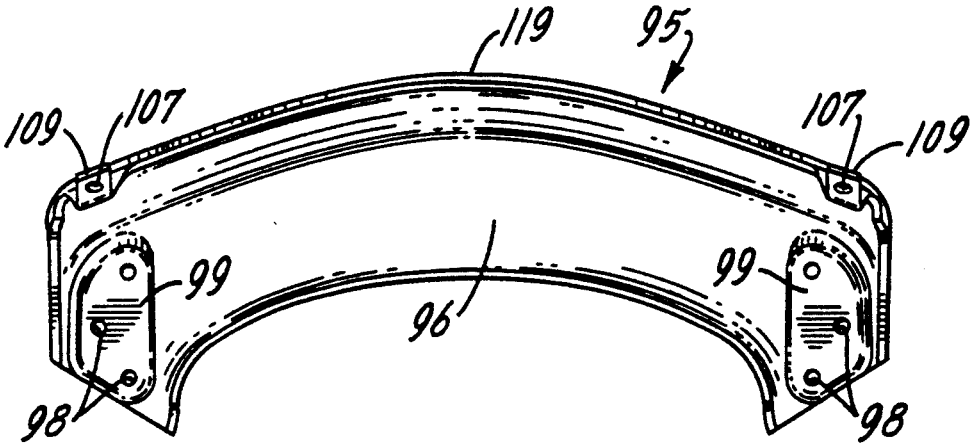
FIG. 9 is a top plan view of the outer shell.
Figure 10:
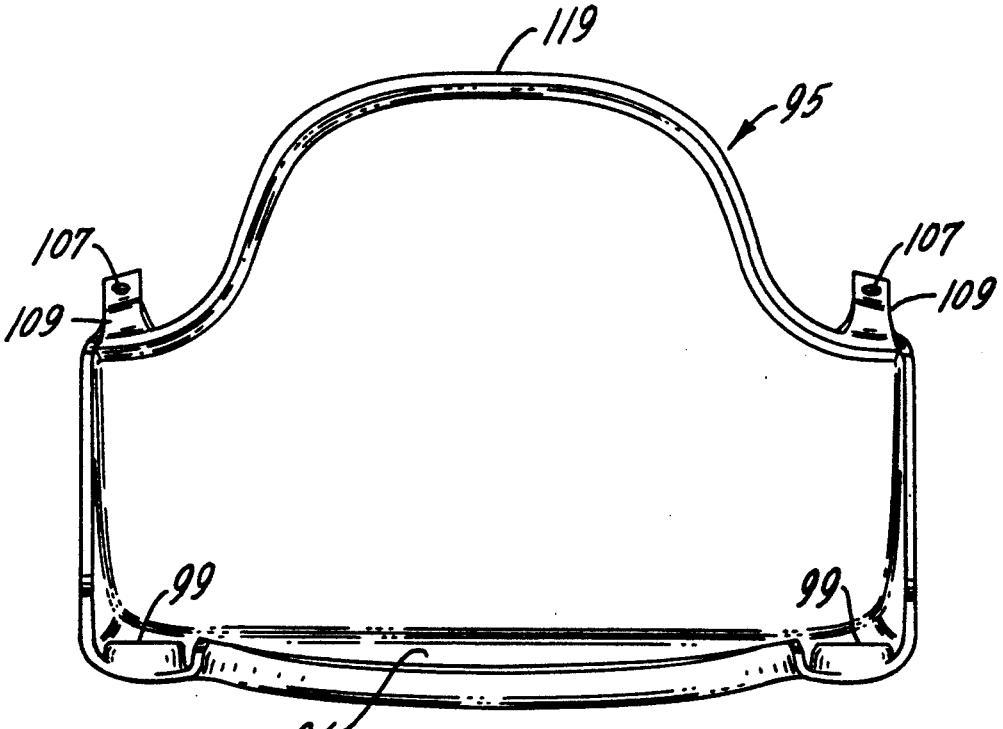
FIG. 10 is a front elevational view of the outer shell.

FIG. 1 of the drawings shows an office chair 11 of the type generally referred to as a knee-tilt chair. A chair of this type has a seat 13 and a back 15 which may be formed integrally or separately and are supported on a stretcher tube 17 (FIG. 2) which rotates about a horizontal axis located near the front of the chair and forward of the chair post tube 19. As is conventional, the stretcher tube is mounted on a chair control housing 21 for rotation about a horizontal axis defined by a pivot tube 23 affixed to the stretcher tube 17, as shown in FIG. 2. The chair control housing 21 is attached to the chair post tube 19 for rotation about a vertical axis defined by the post tube. The stretcher tube and chair control housing are enclosed by plastic trim covers 25 and 27, respectively, for aesthetic purposes.

As can be seen best in FIGS. 2, 3 and 4 of the drawings, the stretcher tube 17 is U-shaped with arms 29 that extend rearwardly of the front of the chair. Attached to the ends of the arms and extending rearwardly on each side of the chair are brackets 31. Each bracket 31, as can be seen most clearly in FIG. 6, is formed from an elongated piece of metal having an inverted, channel-shaped portion 33, with an upstanding rib 35 formed integrally on one side thereof. The upper surface 37 of the inverted, channel-shaped portion is arcuate on the portion thereof that faces the inside of the U-shaped stretcher tube, while the top edge 39 of the upstanding rib is generally flat.

A molded, one-piece, thin plastic inner shell 41 rests on and is supported by the arcuate upper surfaces 37 of the inverted channels 33, with these surfaces supporting the plastic inner shell near the outer edges of the seat portion 43. Formed integrally with the seat portion of the inner plastic shell is a back portion 45. The seat portion 43 and back portion 45 have concave-shaped front surfaces and convex-shaped rear surfaces. The seat portion has a downturned front portion 46 commonly referred to as a waterfall. The inner plastic shell may be formed of any suitable, flexible and resilient plastic, but a polyester sold by E. I. Du Pont de Nemours & Co., Inc. under the trademark RYNITE 6400 is preferred.

Slots 47, 49 and 51 of various configurations are formed in the seat portion 43 to create flexible, cantilevered support fingers and members 53, 55 and 57 which bend to conform to the posterior region of a person occupying the chair. Elongated slots 59 are formed in the upper section of the back portion 45 of the inner shell. The reasons for the inclusions of slots 47, 49, 51 and 59 in the seat and back portions of the inner plastic shell are set forth in U.S. Pat. No. 4,660,887, which is incorporated by reference into this specification.

Ribs (not shown) are integrally molded on the undersides of the flexible fingers 53, 55 and 57 for strengthening purposes. Similar ribs 61 are formed on the underside of the seat portion 43 of the inner plastic shell and engage the upper surfaces 37 of the brackets 31 in the manner shown in FIG. 6 of the drawings. The plastic inner shell is upholstered with padding (not shown)

which may be a foam or any other conventional padding material. The padding is covered with a wear resistant and decorative material 65, which may be a fabric, leather or a synthetic material.

The seat portion 43 of the plastic inner shell 41 rests on the arcuate upper surfaces 37 of the brackets 31 through the intermediary of its downwardly-projecting ribs 61. The shell is held against upward, sideways and forward and backward displacement by integrally-formed, downwardly-extending loops 71 of the inner shell, which are fastened to the brackets by shouldered screws 73, as shown in FIGS. 5 and 6 of the drawings. The shouldered screws extend horizontally through the loops 71 and into threaded holes formed in the arcuate surfaces 37 of the brackets 31. The shoulder on each screw engages the bracket to prevent the head of the screw from clamping the loop 71 between the screw head and the bracket, thus providing limited lateral flexibility for the loop. The threads of the screws 73 are treated with an adhesive such as Scotch-Grip 2353 or Loctite brand to prevent loosening. This adhesive is also applied to the other threaded fasteners hereinafter referred to. The legs of the loop provide inclined ramp surfaces which engage the shoulder of the screw 73. The ramp surface 74 of the rearward leg 75 of the loop is inclined downwardly and rearwardly so that any downwardly deflection of the loop will urge the seat portion 43 rearwardly.

Near the rear of each bracket 31, a hook 76, also formed integrally with the seat portion 43 of the inner shell, extends through an opening 77 formed in the arcuate upper surface 33 of the bracket to fasten under the edge of the bracket. Each hook prevents upward lifting of the seat portion from its supporting arcuate surface 37 of the bracket and also limits forward shifting of the seat portion of the inner shell relative to the brackets 31. The positioning of the support brackets along the opposite sides of the seat portion 43 provides additional flexibility for the center of the seat portion 43, upon the application and removal of the weight of the user on the seat portion, without interfering with the flexibility of the support members 53, 55 and 57 formed in the seat portion. For similar reasons, the attachment of the inner shell to the brackets 31 below the seat portion 43 does not affect the ergonomic characteristics of the seat portion of the inner shell.

A metal plate 91 is welded to the bottom of each bracket 31 and has screw holes 93 formed therein for the attachment of an outer shell 95 to the brackets. Additional screw holes are also provided in the plate to provide attachment for arms 96, shown in FIG. 1, but the manner of attachment of the arms to the plate has been omitted for clarity of illustration.

The outer shell 95 is both a strengthening and decorative member of the chair and extends partially beneath the seat portion 43 of the inner shell 41 and partially behind the back portion 45 of the inner shell to provide support for the back portion of the inner shell and to transfer loads from the back portion of the inner shell to the brackets 31 and the stretcher tube 17 of the chair assembly. The outer shell is shaped such that it does not contact the seat portion 43 of the inner shell and contacts the back portion 45 at only two locations, both along the side edges of the back portion and away from the slots formed in the back portion. The outer shell is molded of a strong plastic and has a thickness such that it is stronger and much less flexible than the inner shell 41. The outer shell is also strengthened by an arcuate shaped, upwardly opening channel 96 formed in the base thereof. Preferably, the outer shell is molded from a nylon sold by E. I. Du Pont de Nemours & Co., Inc. under the name "Zytel".

In this embodiment of the invention, the outer shell 95 is fastened to the seat-supporting structure by three screws 97 which thread into holes 93 formed in the plate 91 on each bracket 31. The screws 97 extend through clearance holes 98 formed in recessed flats 99 formed integrally in the channel portion 96 of the outer shell 95. The outer shell is fastened to the back portion 45 of the inner shell by screws 101, one on each side. The screws 101 thread into holes 103 located in bosses 105 formed on the back surface of the back portion 45 of the inner shell and extend through openings 107 located in brackets 109 formed integrally with the back shell 93. The openings 107 in the brackets are clearance openings and each screw 101 has a head 111 which engages the bracket to hold the bracket against the boss. This arrangement transfers both static and dynamic loads from the back portion of the inner shell through the outer shell 93 and to the brackets 27.

A decorative panel 115 is attached to the upper portion of the back portion 45 above the back shell 95 by barbed clips (not shown) seated in openings 117. The lower edge of the decorative panel 115 overlaps the recessed upper edge 119 of the outer shell 95.

I claim:

1. A chair construction, including:

a flexible, resilient inner shell formed of a plastic and having a seat portion with side edges, a pair of supports formed separately from said inner shell and located below said seat portion of said inner shell, each of said supports engaging and supporting said seat portion along a side edge of said seat portion, means attaching said seat portion of said inner shell to said supports to limit upwardly, laterally, rearwardly and forwardly movement of said seat portion of said inner shell relative to said supports when no weight is applied to said seat portion while not interfering with the downwardly flexing of said seat portion relative to said supports when weight is applied to said seat portion, said means including loops extending from said seat portion and mounted for limited downward movement relative to said supports as the seat portion flexes downwardly when weight is applied thereto.

2. The chair construction of claim 1 in which said means attaching said seat portion of said inner shell to said supports includes:

a pair of upwardly opening loops extending downwardly from said seat portion of said inner shell inwardly of said side edges of said seat portion, each loop positioned along side one of said supports and having a bight portion at its lower end, fasteners extending through said loops above said bight portions to engage said bight portions to prevent upwardly movement of said seat portion when no weight is applied to said seat portion while permitting limited downward movement of said loops when weight is applied to said seat portion, and hooks formed as part of said seat portion with said hooks extending downwardly from said seat portion into slots formed in said supports with said hooks engaging said supports inside said slots around edges of said slots to prevent upwardly movement of said seat portion when no weight is applied to said seat portion, said hooks being located rearwardly of said loops.

3. The chair construction of claim 1 in which said curved portion of each of said supports is formed as an inverted channel.

4. The chair construction of claim 1 in which said curved surfaces of said supports slope toward the inside of said seat portion.

5. The chair construction of claim 1 in which said means attaching said seat portion of said inner shell to said supports attach to said supports below said seat portion.

6. A seat and back construction for an office chair, including:

a U-shaped stretcher tube adapted to be supported on a chair post, a pair of brackets attached to the opposite ends of the U-shaped stretcher tube, an inner shell formed of a flexible, resilient plastic and having a seat portion and a back portion, said seat portion of said inner shell supported on said pair of brackets for flexing movement of the center of said seat portion relative to said brackets, an outer shell formed of a plastic with said outer shell being more rigid than said inner shell, and means connecting said outer shell to said brackets and to said back portion of said inner shell to transfer loads applied to said back portion of said inner shell to said brackets.

7. The seat and back construction of claim 6 in which said means connecting said outer shell to said brackets includes flats formed on said outer shell to engage said brackets and fasteners extending through said flats and into said brackets.

8. The seat and back construction of claim 6 in which said means connecting said outer shell to said back portion of said inner shell includes brackets formed on opposite sides of said outer shell, bosses formed on said back portion of said inner shell and fasteners extending through said brackets and into said bosses.

* * * * *